United States Patent [19]

Wier

[11] Patent Number: 4,621,394

[45] Date of Patent: Nov. 11, 1986

[54] BUCKLE FOR A SAFETY BELT

[75] Inventor: Franz Wier, Goeggingen, Fed. Rep. of Germany

[73] Assignee: TRW Repa GmbH, Alfdorf, Fed. Rep. of Germany

[21] Appl. No.: 644,050

[22] Filed: Aug. 24, 1984

[30] Foreign Application Priority Data

Aug. 31, 1983 [DE] Fed. Rep. of Germany ..... 3331467

[51] Int. Cl.[4] ..... A44B 11/26

[52] U.S. Cl. ..... 24/642; 24/641

[58] Field of Search ..... 24/633, 637, 642

[56] References Cited

U.S. PATENT DOCUMENTS

| | | | |
|---|---|---|---|
| 4,197,619 | 4/1980 | Burleigh | 24/642 |
| 4,228,567 | 10/1980 | Ikesue et al. | 24/642 |
| 4,392,282 | 7/1983 | Wier | 24/642 |

FOREIGN PATENT DOCUMENTS

| | | | |
|---|---|---|---|
| 3004150 | 8/1981 | Fed. Rep. of Germany | 24/642 |
| 3027009 | 2/1982 | Fed. Rep. of Germany | 24/642 |
| 2377780 | 8/1978 | France | 24/642 |
| 2083542 | 3/1982 | United Kingdom | 24/642 |

*Primary Examiner*—Peter A. Aschenbrenner
*Attorney, Agent, or Firm*—Yount & Tarolli

[57] ABSTRACT

A buckle for a safety belt, the buckle including a base plate with a guide channel for insertion and withdrawal of a tongue, a latching member movable in a guide member mounted on said base plate and cooperating with the tongue for selective engagement and disengagement of the tongue, and a pressure key slidably mounted on the base plate and movable in a direction parallel to said guiding channel between a rest position and a depressed position. The pressure key when moving to the depressed position moves the latching member to disengage the tongue. The pressure key is biased into its rest position by at least one leaf spring member having a first end secured on the guide member and a second, free end bearing on a surface portion of the pressure key.

6 Claims, 7 Drawing Figures

FIG. 3a
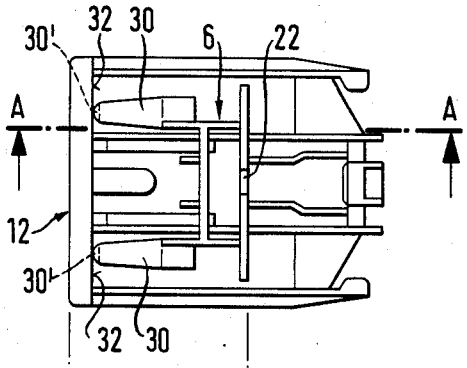
FIG. 3b
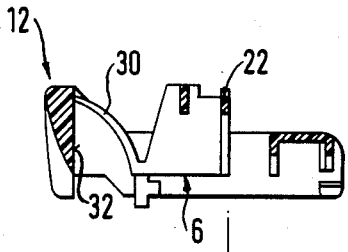
FIG. 4a
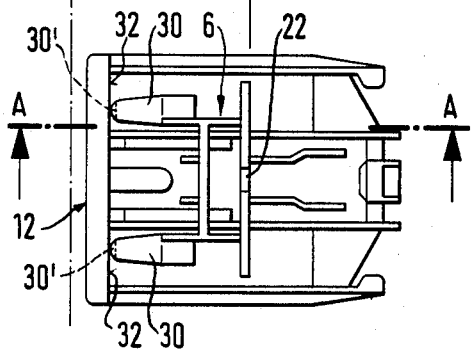
FIG. 4b
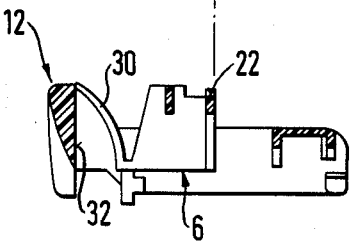
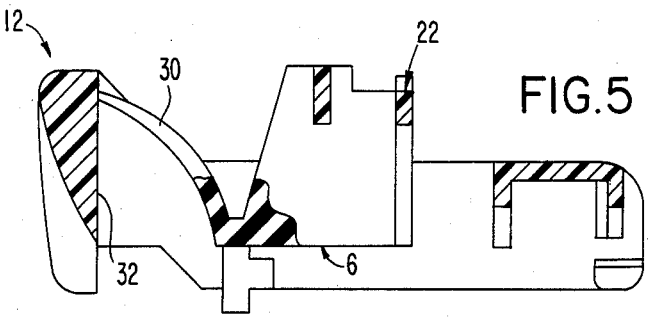
FIG.5

BUCKLE FOR A SAFETY BELT

The invention relates to a buckle for a safety belt.

In known belt buckles of this kind, in which, for the unlocking of the bar, movable transverse to the insertion path of the belt insertion (plug) tongue, a pressure key, movable parallel to the insertion path is provided, one or more metal springs are fastened to the lock housing for this pressure key. The movement (pushing) of the pressure key takes place against the force of these metal springs, which after the unlocking process, press the pressure key back into the original position. The arrangement of special metal springs for the pressure key requires great expense for mounting and adjusting and makes the whole belt more expensive.

The invention attacks the problem of designing a belt buckle so that its construction is greatly simplified and its function improved, with special attention to low preparation costs.

Through the solution according to the invention, the advantage is given that through the leaf-spring-like design of the spring or springs, the expense in prefabrication and in mounting and adjustment is very greatly reduced as compared, for example, with spiral or coil springs, since the fastening of these springs to the lock housing is simplified. Thus, these springs can be very simply formed on the lock housing or welded to it, and no means are needed for guiding and holding these springs, such as guide page, for example, and the like.

According to a further development of the invention, the spring or springs are a one-piece component of a part, preferably designed as an injection molded plastic part, of the buckle housing, especially the bar guide of the lock housing. Here, these springs preferably consist of plastic material. In this way, costs for parts, mounting and adjustment are advantageously saved.

According to another development of the invention, the spring or springs are bent in sickle or hook form. Contrary to other spring designs, the advantage is obtained here that even with strong action of heat, the spring action in relation to the pressure key cooperating with the spring is unchanged; that is, there is no decrease of force, especially with the springs, by their free ends, in the unactuated position, run at least approximately in the path of movement of the pressure key.

Other advantageous details of the invention will appear from the example of the invention shown in the drawing and described below.

FIGS. *3a*, *3b* and FIGS. *4a*, *4b* show the belt lock according to the preceding figures, in each case, in top view and side section, and in two different operating positions.

FIG. 5 is a fragmentary view, similar to FIG. *3b*, but on an enlarged scale, illustrating the manner in which the spring is integrally formed with a guide bar.

Figure 1:
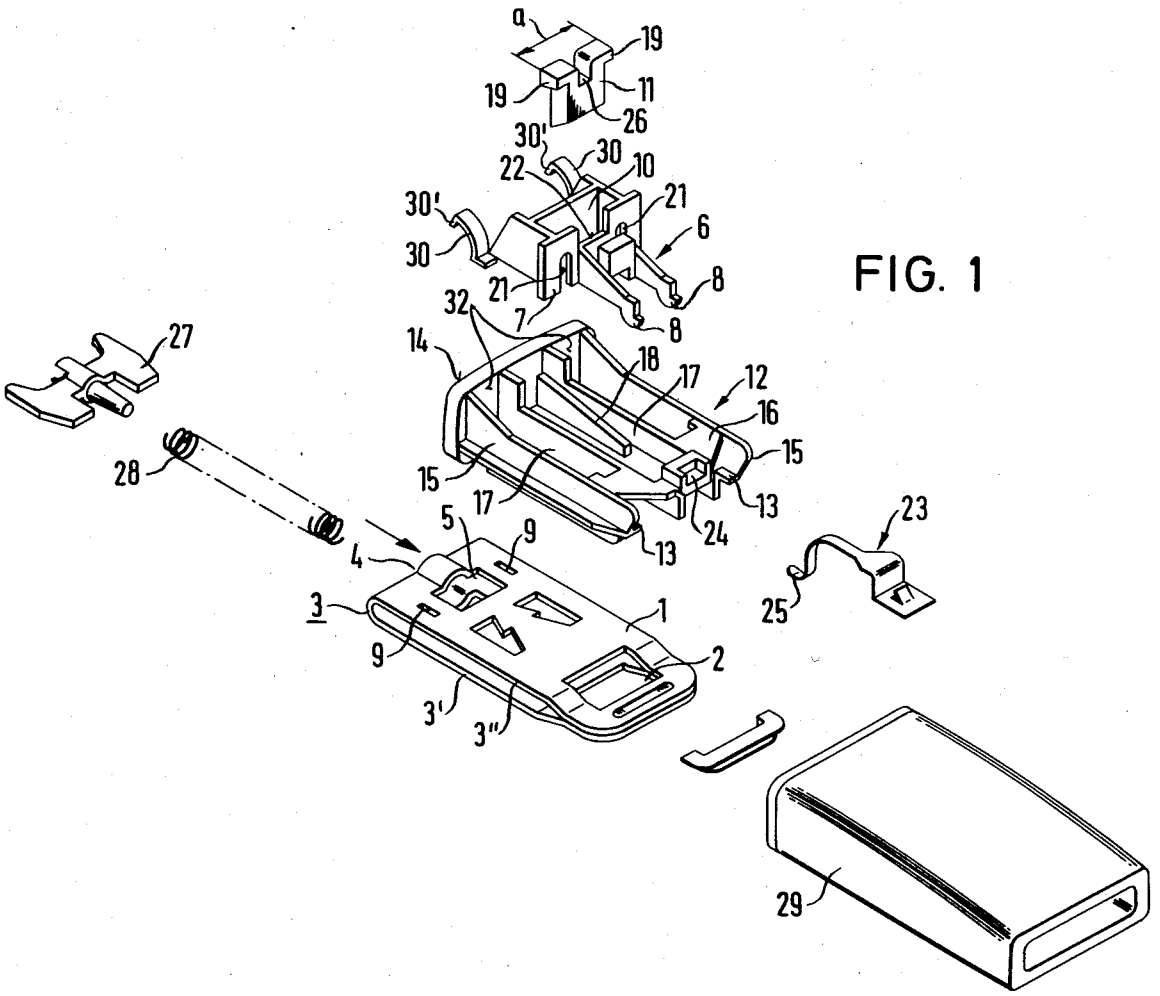
FIG. 1 shows an exploded representation of the belt buckle.
Figure 2:
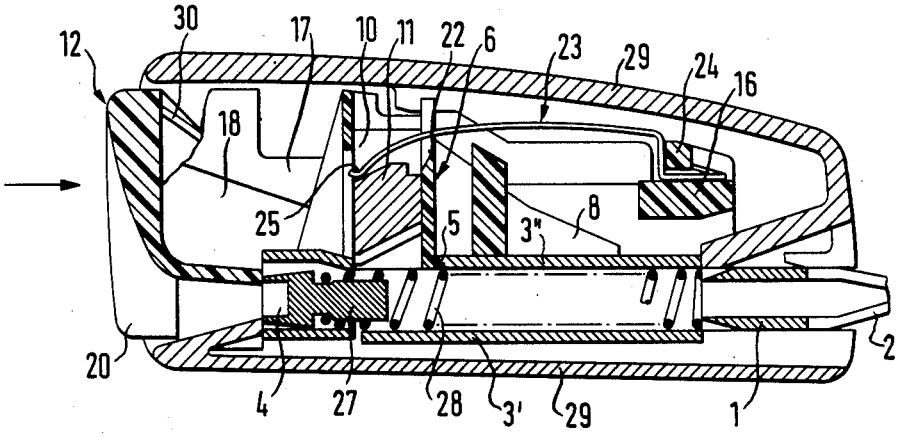
FIG. 2 shows a side section view of the belt lock according to FIG. 1, in the unactuated rest position.

FIGS. 1 and 2 show clearly the construction of the belt buckle. Here the stable base for the belt buckle is a metal platen 1, bent in a U shape, which at the open end has openings 2 for fastening to a free end of the belt band or to a fitting, fastened to the floor of the vehicle, for example. These free ends of the platen are bent together and lie one on the other. At the non-free leg 3 of the platen is an insertion (receptacle) openings 4, for a belt band tongue, designed in a manner known per se and not further shown, for which the two platen parts 3' and 3'', in connection with the insertion opening 4, form an insertion path. In the platen 1, bar openings 5 are present for the insertion of a bar, to be described below, transverse to the insertion path (arrow direction). There can be fastened to the platen part, which can be fastened, for example, by means of additions 7 and 8 into openings 9, for example, of the platen part 3''. The bar guide 6 has a guide channel 10 passing through it, in which a metal bar 11 can be pushed, transverse to the insertion path. Designated generally by 12 is a pressure key, also designed as an injection molded plastic part, which is supported, movable parallel to the insertion path, on the platen part 3'' and on the bar guide 6. For this, the pressure key 12 has, at the lower edges of the side limits, slide cheeks 13, drawn inward, and a pressure surface 14 perpendicular to same. The pressure key is given its form stability through the side cheeks 15 and through a connection stay 16 between these cheeks. Between the side cheeks 15 are guide cheeks 17, of which the distance apart corresponds approximately to the width a of the bar 11. On the inner sides of these guide cheeks 17 are lifting surfaces 18, inclined diagonal, of which only one can be seen in FIG. 1. By these lifting surfaces 18, the bar 11 cooperates with the projections 19, which have diagonal slide surfaces, which with movement of the pressure key in the arrow direction, run up on the lifting surfaces 18 and slide on them to carry out the bar lift. The pressure key 12, which is provided on the front side with an insertion opening, slides by its guide cheeks 17 into slot-like openings 21 of the bar guide 6. The bar guide has also a rigid run-up (transition) edge 22, formed in one piece with it, which cooperates, as will be described below, with an arc or sickle-like spring 23. This spring 23 is fastened by one free end to a block-like bearing point 24 of the pressure key 12, for example, by welding with the plastic material. From this bearing point 24 extends the spring 23 in sickle form over the run-up edge 22, as shown particularly in FIG. 2, and is supported by the free end 25 against the bar 11, namely in a groove-like opening (hollow) 26. This spring 23 presses the bar 11 into the locking position when the pressure key 12 is released. In which the bar 11 projects into the insertion path and locks the inserted tongue in a manner known per se. The interaction of the spring 23 with the other components of the buckle is described and claimed in co-pending Application Ser. No. 644,049 filed Aug. 24, 1984 and entitled "Belt Lock for a Safety Belt." FIG. 2 shows the position of the belt lock in which the tongue is not inserted and in which the bar 11 is supported against a ejector (throw-out) 27, movable lengthwise in the insertion path. With insertion of the tongue, the ejector is pressed back along the insertion path against the force of the spring 28, until the spring-weighted bar 11 is set free and falls into the corresponding opening in the insertion tongue, and locks the latter. If the insertion tongue is to be unlocked, the pressure key 12 is pushed in the arrow direction opposite the platen 1 and opposite the bar guide 6, together with the spring 23. With this, after a certain empty stroke, the strongly curved free end 23 runs up on the run-up (transition) edge 22 and is relieved or slightly raised by the bar 11, at first not yet raised. It is also shown in FIG. 2 that the parts illustrated are surrounded by a shell-like housing 29, which also forms a part of the insertion opening. As shown particularly in FIG. 1, on both sides of the bar guide 6 are two springs 30, also sickle-like, formed in one piece, which are supported against the inside of the pressure surface 14 of the pressure key 12, and which provide, after the pressing of the pressure key, for returning the latter to the original or rest position. The free end of these springs 30 has a widened round addition 30'. These springs are components in one piece with the bar guide 6, and like the bar guide are made of plastic. These parts may be made in common in an injection molding process. They cooperate with the vertical inner limit surfaces 32 of the pressure key 12 so that, with pushing of this pressure key 12 in the arrow direction according to FIG. 2, the free ends of the springs 30 are supported against the said surfaces 32 and are then prestressed.

In FIGS. 3*a*, 3*b* and 4*a*, 4*b* the mode of operation of the belt lock is illustrated, so far as parts essential to the invention are concerned. The top view representation and the section along the line A—A are compared in each case. The section views show only the parts necessary to understanding, namely, the pressure key 12, the bar guide 6 of the lock housing and the formed sickle-shaped springs 30, In all these figures, the lock housing and thus the bar guide 6 also are in the same position, which is shown by dot-and-dash lines. In FIGS. 3*a* and 3*b*, the pressure key 12 is in the unactuated rest position, while in FIGS. 4*a* and 4*b*, the pressure key is in the fully actuated, that is, in the fully depressed position.

In the rest position according to FIGS. 3*a* and 3*b*, the free end of the springs 30 just touches the surface 32 of the pressure key 12, the free spring ends being so arranged that they are approximately at right angles to the surface 32. On depressing the pressure key 12, the springs are prestressed and the free spring ends slide on the surface 32 according to FIGS. 4*a* and 4*b*, upward to near the edge of the surface 32. With strong action of heat, the sickle form of the springs 30 slightly changes, namely, so that the free spring ends, for example, according to FIGS. 3*a* and 3*b*, lie farther down against the surface 32. However, the spring action of these springs 30 is particularly unchanged thereby, so that in every case at almost any surrounding temperature, constant pressure conditions against the pressure key 12 are assured.

I claim:

1. A buckle for a safety belt, said buckle comprising a base plate with a guiding channel for insertion and withdrawal of a tongue, a latching member movable in a guide member mounted on said base plate and cooperating with the tongue for selective engagement and disengagement of the tongue, and a pressure key slidably mounted on said base plate and movable in a direction parallel to said guiding channel between a rest position and a depressed position, said pressure key when moving to said depressed position moving said latching member to disengage said tongue, said pressure key being biased into its rest position by at least one leaf spring member having a first end secured on said guide member and a second, free end bearing on a surface portion of said pressure key.

2. A buckle according to claim 1 wherein said leaf spring and said guide member are one piece.

3. A buckle according to claim 1 wherein said leaf spring and said guide member are plastic.

4. A buckle according to claim 1 wherein said leaf spring has an arcuate hook-shaped configuration.

5. A tongue receiving buckle assembly for use with a safety belt, said buckle assembly comprising a metal base plate which at least partially defines a channel into which the tongue is insertable, a plastic mounting element fixedly connected with said base plate, a latch bar slidable on said mounting element between an engaged position engaging the tongue to hold the tongue against withdrawal from the channel and a release position in which the tongue is released for movement from the channel, a plastic key member slidable along the base plate between an extended position and a retracted position, said key member including surface means for moving said latch bar from the engaged position to the release position upon movement of said key member from the extended position to the retracted position, and spring means for urging said key member toward the extended position, said spring means including first and second leaf springs formed of plastic and disposed adjacent to opposite sides of said mounting element, each of said leaf springs having a first end portion which is fixedly connected with said mounting element and a free end portion which is disposed in abutting engagement with said key member and is movable relative to said base plate, said free end portions of said first and second leaf springs being slidable on said key member in a direction away from said base plate and toward said first end portions of said first and second leaf springs to resiliently deflect said first and second leaf springs under the influence of forces applied to said leaf springs by said key member upon movement of said key member from the extended position to the retracted position.

6. A buckle assembly as set forth in claim 5 wherein said first and second leaf springs are formed as one piece with said mounting element.

* * * * *